United States Patent [19]

Crane

[11] Patent Number: 4,977,407

[45] Date of Patent: Dec. 11, 1990

[54] OPTICAL COLLIMATOR

[76] Inventor: Patrick E. Crane, 8405-A Benjamin Rd., Tampa, Fla. 33634

[21] Appl. No.: 802,239

[22] Filed: Nov. 27, 1985

Related U.S. Application Data

[63] Continuation-in-part of Ser. No. 286,231, Jul. 23, 1981.

[51] Int. Cl.[5] ..... H01Q 19/06

[52] U.S. Cl. ..... 343/753; 343/755; 343/781 CA

[58] Field of Search ..... 343/755, 756, 781 P, 343/781 CA, 873, 911 L, 753, 911 R, 754; 350/442–445, 620

[56] References Cited

U.S. PATENT DOCUMENTS

| | | | |
|---|---|---|---|
| 2,668,869 | 2/1954 | Iams | 343/755 X |
| 3,195,137 | 7/1965 | Jakes, Jr. | 343/756 |
| 3,281,850 | 10/1966 | Hannan | 343/756 |
| 3,287,728 | 11/1966 | Atlas | 343/753 |
| 3,340,535 | 9/1967 | Damonte et al. | 343/781 CA |
| 3,771,160 | 11/1973 | Laverick | 343/756 |
| 3,820,116 | 6/1974 | Carlsson et al. | 343/756 |
| 4,148,040 | 4/1979 | Lunden et al. | 343/708 |
| 4,188,632 | 2/1980 | Knox | 343/781 P X |

FOREIGN PATENT DOCUMENTS

| | | | |
|---|---|---|---|
| 0084420 | 7/1983 | European Pat. Off. | 343/781 CA |
| 0019047 | 2/1977 | Japan | 343/753 |
| 0133050 | 10/1979 | Japan | 343/753 |
| 0170502 | 3/1960 | Sweden | 343/781 CA |

*Primary Examiner*—Eugene R. LaRoche
*Assistant Examiner*—Seung Ham
*Attorney, Agent, or Firm*—James Creighton Wray

[57] ABSTRACT

An antenna adapted for millimeter wave applications has a dielectric lens with metalized reflective surfaces and uncoated refractive surfaces. A subreflector and polarization grating are provided on the central portion of a refractive surface.

28 Claims, 2 Drawing Sheets

OPTICAL COLLIMATOR

This is a Continuation in Part of application Ser. No. 286,231 filed July 23, 1981.

BACKGROUND OF THE INVENTION

This invention relates generally to antennas and more particularly has reference to a new class of antenna for millimeter wave applications.

Pertinent United States and foreign patents are found in Class 343, subclasses 753, 754, 755, 781, 911 and 914, and Class 350, subclasses 29, 30, 31, 290, 292, 293, 397, 398, 409, 415 and 432 of the official classifications of patents in the United States Patent and Trademark Office.

Examples of pertinent patents are U.S. Pat. Nos.: 3,787,872; 3,716,869; 3,414,903; 2,547,416; 3,611,391; 3,389,394; 3,317,911; 3,430,244.

U.S. Pat. No. 3,787,872 shows a microwave antenna that can transform energy passing through a lens to a desired specific phase and amplitude distribution. The lens is made of dielectric material. Each surface of the lens is contoured independently.

U.S. Pat. No. 2,547,416 shows a dielectric lens used for microwave refraction. The lens is used to convert approximately spherical wave radiation into substantially plane radiation.

U.S. Pat. No. 3,317,911 shows a lens used in a passive electromagnetic lens system. A plane reflector is placed behind the lens to send transmitted energy through the lens.

U.S. Pat. No. 3,716,869 shows a millimeter wave antenna having a parabolic reflector and a hyperbolic subreflector. A feed is centrally located on the parabolic reflector to form a cassegrain system.

U.S. Pat. No. 3,611,391 shows a cassegrain antenna wherein a dielectric guiding structure is arranged between the mouth of the feed and the convex surface of the subreflector. Energy reflected by the subreflector is bent as it passes through the guide.

U.S. Pat. No. 3,430,244 shows an antenna having a solid dielectric guiding structure interposed between the feed and reflector for preventing spillover lobes.

U.S. Pat. No. 3,414,903 shows an antenna system having a dielectric horn structure interposed between a feed source and lens.

U.S. Pat. No. 3,389,394 shows a multiple frequency antenna including a solid dielectric horn member for guiding high frequency waves.

No patent was found to disclose a mill meter wave antenna having a lens-shaped dielectric with metal-coated reflective surfaces.

SUMMARY OF THE INVENTION

The present invention overcomes many problems existing in the prior art antennas.

The antenna of the present invention has a lens-shaped element formed of dielectric material. An uncoated surface refracts electromagnetic waves and a metal-coated surface reflects electromagnetic waves. A subreflector can be provided on a central portion of the refractive surface to provide collimation of electromagnetic waves with two reflective and one refractive surface. A polarization grating may be used to cut blockage produced by the subreflector.

The present invention is a new class of antenna for millimeter wave applications which combines the properties of lenses and reflectors to reduce the volume occupied by the antenna and provide numerous advantages over the prior art.

The antenna of the present invention occupies a smaller volume than any previously known antenna of comparable performance. It is known that flat plate arrays can be smaller than the present antenna, but such arrays offer lower performance than the present antenna at high frequencies.

Another advantage of the present invention is that it can be built to conform to a wide variety of available spaces, since any one surface can be defined arbitrarily as a smooth contour and the other surfaces built to accomodate or compensate for the predefined surface Still another advantage is that the present antenna is amenable to integrated circuit technology being made an integral part of the antenna, i.e., an integrated circuit may be printed or bonded to the dielectric surface.

The present antenna can be built as a monopulse system, lobe switched system or multifeed system with far greater latitude in feed design than prior antennas because the dielectric medium allows closer spacing of feed and smaller apertures.

A further advantage is that the present antenna requires no support structures and thus minimizes blockage aberrations and volume occupied.

The present antenna is amenable to mass production techniques because only one part is required. That part can be molded, cast, machined or otherwise produced. All reflective surfaces are metalized.

Blockage is further reduced in the present invention because the subreflector can be made smaller than in conventional cassegrain systems. The dielectric medium used in the present invention has the effect of making the reflector electrically larger than it would be in free space.

Another advantage of the present antenna is that it allows polarization diversity.

Objects of the invention are to provide an improved antenna and to provide a new class of antenna for millimeter wave applications.

Another object of the invention is to provide an antenna of reduced volume.

Still another object of the invention is to provide an antenna which combines the properties of lenses and reflectors.

A further object of the invention is to provide an antenna which is capable of being integrally formed with integrated circuits.

Yet another object of the invention is to provide an antenna which reduces blockage aberrations.

A further object of the invention is to provide an antenna which is amenable to mass production techniques.

These and other and further objects and features of the invention are apparent in the disclosure which includes the above and below specification and claims and drawings.

DETAILED DESCRIPTION OF THE INVENTION

The present invention relates to a new class of antenna for millimeter wave applications. The antenna is particularly useful with forward looking missile guidance and airborne radar systems where space is at a premium and where low cost mass reproducibility is needed.

Although it is anticipated that the advantages of the present invention will most readily find application in the guidance and radar environment, the broad teachings and techniques of the present invention are also useful in optic systems.

Figure 1:
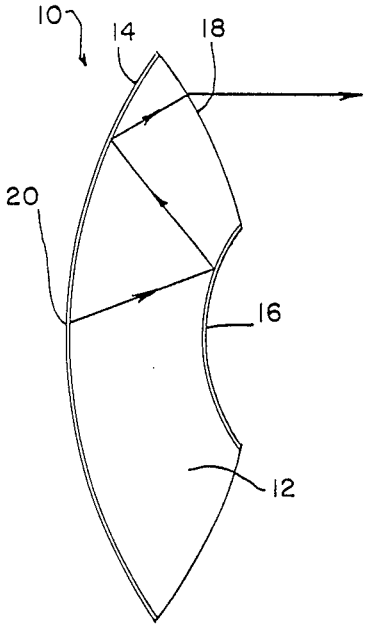
FIG. 1 is a side view, in section, of an antenna embodying features of the present invention.
Figure 2:
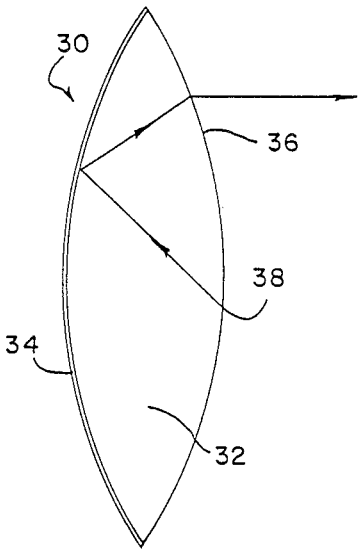
FIG. 2 is a side view, in section, showing another embodiment of the present invention.
Figure 3:
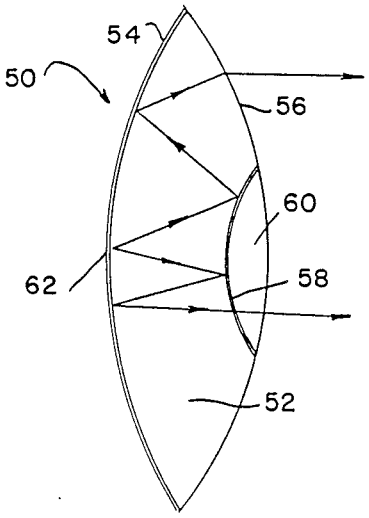
FIG. 3 is a side view, in section, showing yet another embodiment of the present invention.

FIGS. 1–3 are planar cuts through the axis of propogation of the antenna. Viewed from the front, the antennas may be either a circular system for production of pencil beams, or any other shape which produces a desired radiation in a pattern characteristic. Moreover, the system need not be symmetrical.

The system can be understood in terms of ray optics and Snell's Laws of reflection and refraction.

The antenna system 10 shown in FIG. 1 has a biconvex lens-like element 12 formed of dielectric material. A surface 14 of the element 12 is metalized, i.e., coated with a reflective metal material. A central portion 16 of the opposite surface 18 is also metalized. The remainder of the surface 18 is uncoated.

The element 10 is positioned to receive the output of any conventional electromagnetic wave source. Wave guides, electromagnetic horns and dipoles are examples of electromagnetic sources which can be used with the present invention. The source (not shown) and the antenna 10 are positioned so that electromagnetic waves are fed into the antenna 10 at a feed point 20 located centrally on the reflective surface 14.

The ray path or the received electromagnetic waves is indicated in the figure. The waves emerge from the feed point 20 and impinge upon the subreflector formed by the metalized central portion 16 of surface 18. The subreflector 16 reflects the waves toward the primary reflective surface 14. The waves are reflected by the primary reflective surface toward the refractive surface formed by the uncoated portions of surface 18. The waves are refracted as they pass through the refractive surface 18 and are emitted from the antenna in a direction generally parallel to the axis of the antenna.

The antenna 10 operates in such a manner that a ray entering the dielectric element 10 from the feed point 20 is reflected from the metalized subreflector 16 back to a point on the reflective surface of the primary reflector 14, where it is partially collimated, i.e., directed back toward the desired axis of propogation, and directed to a point of exit from the dielectric element 12. The refractive surface 18 of the dielectric element 12 is formed in such a contour that it completes the collimation and causes all rays emerging from the surface 18, and originating at the feed point 20, to follow parallel paths in free space.

Because one collimation function is performed by two reflective surfaces 14 and 16 and one refractive surface 18, an infinite variety of contours can be used.

The overall thickness of the antenna can be controlled by varying the dielectric constant of the material used to form the elements 12. The thickness of the element 12 varies roughly inversely with the square root of the dielectric constant. In other words, relatively thin elements 12 can be formed by using materials having a large dielectric constant and relatively thick elements 12 can be formed using dielectric materials having a small dielectric constant.

The antenna 30 shown in FIG. 2 is another embodiment of the present invention.

Biconvex dielectric element 32 is provided with a reflective, i.e., metalized, surface 34 and an opposite uncoated refractive surface 36. Electromagnetic waves from a suitable source enter the antenna 30 at a feed point 38 located in the center of the refractive surface 36.

As shown in FIG. 2, rays entering the element 32 at the feed point 38 are reflected by the primary reflective surface 34 toward the refractive surface 36. The rays are refracted as they pass through the surface 36 and are emitted from the antenna 30 in a direction generally parallel to the axis of the antenna 30.

The electromagnetic waves emitted by the antenna 30 shown in FIG. 2 are similar to the waves emitted by the antenna 10 shown in FIG. 1 where the feed point 38 is at the focal point of the primary reflector 38. The antenna 30 does not use a subreflector and is thus less expensive to produce than the antenna 10.

The antenna 50 shown in FIG. 3 is yet another embodiment of the present invention.

The antenna 50 is similar to the antenna 10 in that it has a biconvex dielectric element 52 provided with a reflective surface 54, an opposite refractive surface 56, and a subreflector surface 58 formed on a concave central portion of the surface 56. The antenna 50 differs from the antenna 10 in that a polarization grating 60 is provided for the subreflector 58.

Electromagnetic waves from a conventional source (not shown) enter the antenna 50 at a feed point 62 located in the center of the primary reflective surface 54. A portion of the radiation entering the feed point 62 travels a path which is similar to the path traveled by the radiation entering the antenna 10, namely, it is reflected by the subreflector 60 toward the primary reflector 54 which reflects it toward the refractive surface 56 from which it is emitted in a path generally parallel to the axis of the antenna 50. A remaining portion of the radiation is reflected by the subreflector 58 toward the primary reflector 54 which reflects it back towards the subreflector 58. Primary reflector 54 is a polarization rotating reflector known more commonly as a twisting reflector. The polarization grating 60 allows the reflected waves to be emitted from the antenna 50 in a direction generally parallel to the axis of the antenna. The latter rays were not emitted from the antenna 10 because they were blocked by the subreflector 16. The antenna 50 uses polarization twisting to eliminate the blockage produced by the subreflector 58. The polarization grating 60 is polarization sensitive in that it is highly transmissive for one sense of polarization and highly reflective for the orthogonal sense of polarization.

It will be readily apparent to any persons skilled in the art that the antenna systems 10 and 50 shown in FIGS. 1, and 3 respectively employ principles of the well known Cassegrain systems. However, the present invention is not limited to Cassegrain systems and can be used with antenna system and configuration.

Although the antennas 30 and 50 shown in FIGS. 1–3 respectively are formed of generally bi-convex dielectric elements, it is readily apparent that the present invention is not limited to bi-convex elements. The shape of the dielectric element can be varied to produce any desired shaped beam characteristics.

Similarly, the arrangement, shape and number of the reflected surfaces and refracted surfaces can be varied to produce the desired shaped beam characteristics.

Techniques for the varying refractive and reflective surfaces to produce desired shaped beam characteristics are well-known in the art as indicated by the patents described in the Background portion of this specification.

The present invention is not limited to forming the reflective surfaces by metalization. It is contemplated that the reflective surfaces can be formed by treating the dielectric surfaces in any manner which is effective to provide those surfaces with reflective properties.

The term "uncoated" as used herein is intended to describe the absence of any material on a dielectric surface which would destroy the refractive properties of that surface. It is not meant to exclude materials, treatments or coatings which would not destroy the refractive properties of the surface.

Figure 4:
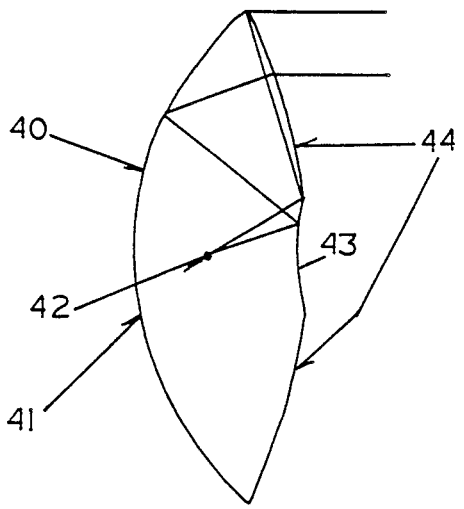
FIG. 4 is an alternate antenna.

Referring to FIG. 4, a similar embodiment to FIG. 1 is disclosed. However, antenna 40 is a single molded or fired solid body requiring no support structure and includes feeds 42. None of the surfaces 41, 43, 44 need be predefined. That is, if any two of the surfaces are defined according to any of the infinite variety of contours, a third surface can be synthesized to complete the collimation function. This allows for a versatility never before realized. The antenna may be made to fit within a particular situation rather than the site having to conform to the antenna.

Accordingly, FIG. 4 is just one of many conceivable antennas where 42 is the system focal point. Surface 43 is a reflecting surface and it may be convex or concave depending upon the other surface shapes. Surface 41 is a convex reflecting surface or concave when viewed internally. Surfaces 44 are refracting surfaces and may be convex or concave depending upon the situation. It should be noted that all surfaces may have curve reversals as a function of radius.

As with all the embodiments, the antenna 40 is composed of an electromagnetically transmissible dielectric material. The generic antenna of which FIG. 4 is just a representation has at least two arbitrarily contoured reflective surfaces, one arbitrarily contoured refractive surface, a feed apparatus, and folded optics combined in a one-piece stand alone device to provide a fully collimating antenna or optical collimator.

Specifically excluded from the system are antenna systems using classical Cassegrain or Gregorian optics or having refracting surfaces which are flat or having refracting surfaces which perform no collimation function. Miniaturization is key and therefore surfaces performing no collimation are not involved in any function are highly undesireable and teach away from this teaching.

The contours of FIG. 4 may be spherical while providing aberration-free collimation. This is not possible in current systems.

All the surfaces of FIG. 4 may incorporate Fresnel type zoning for reduction of size, weight, and radar cross-section.

While the invention has been described with references to a specific embodiment, the exact nature and scope of the invention is defined in the following claims:

What I claim is:

1. Antenna apparatus comprising a one-part, biconvex dielectric lens antenna having at least one curved reflective surface provided with reflective media and having at least one refractive surface and having a feed point positioned on the lens opposite one reflective surface.

2. The apparatus of claim 1 wherein the lens has a first surface provided with reflective media and a second opposite reflective surface at least a portion of which is free of reflective media.

3. The apparatus of claim 1 wherein the lens antenna has a first surface provided with reflective media and a second opposite surface having a central portion provided with reflective media and having the remaining portion free of reflective material.

4. The apparatus of claim 1 wherein the lens antenna has a generally biconvex shape.

5. The apparatus of claim 3 wherein said first and second surfaces have generally convex shape and said central portion has a generally concave shape.

6. The apparatus of claim 1 wherein at least one reflective surface is metalized.

7. The apparatus of claim 3 wherein said central portion is provided with a polarization grating.

8. The apparatus of claim 1 wherein the reflective surface is provided with a central feed point for receiving electromagnetic waves transmitted into the lens antenna.

9. The apparatus of claim 2 wherein the second surface is provided with a central feed point for receiving electromagnetic waves transmitted into the lens antenna.

10. Antenna apparatus comprising a dielectric convex lens body having first and second oppositely curved reflective and refractive surfaces, a feed in the lens opposite a center of the wave reflective surface, the first surface having wave reflective means for thereby forming a wave reflective surface for reflecting waves impinging thereon, the second surface forming a curved refractive surface for refracting waves as they pass through the refractive surface for collimating the waves as they pass through the refractive surface, the first wave reflective surface and the second curved refractive surface cooperating in retracting waves for collimating the waves.

11. The antenna apparatus of claim 10 wherein curvatures of the first wave reflective surface and the second curved refractive surface respectively partially collimate and complete collimation.

12. The antenna apparatus of claim 11 wherein the curvature of the first wave reflective surface is coordinate to cooperate with a predetermined curvature of the second curved refractive surface for collimating waves.

13. The antenna apparatus of claim 11 wherein the curvature of the second curved refractive surface is coordinated for cooperating with a predetermined curvature of the first wave reflective surface for collimating waves.

14. The antenna apparatus of claim 11 further comprising a feed point at a center of the second curved refractive surface.

15. The antenna apparatus of claim 11 further comprising a subreflector having a third concave surface centered within the second curved refractive surface.

16. The antenna apparatus of claim 15 further comprising a feed point centered in the first wave reflective surface.

17. The antenna apparatus of claim 16 wherein the subreflector comprises a polarizing grating for permitting passage of collimated waves through the subreflector third surface.

18. The method of using an antenna apparatus comprising directing waves from a feed on a convex lens body into the body and through the convex lens body of dielectric material having first and second oppositely curved convex surfaces, and directing the waves toward a first curved surface, reflecting the waves from the first curved surface toward the second curved surface, passing waves through the second curved surface and refracting the waves, whereby the first curved surface and the second curved surface cooperate for collimating the waves passing out of the second curved surface.

19. The method of claim 18 further comprising directing waves from a feed point in the first curved surface toward a third concave surface centered in the second curved surface an reflecting waves from the third curved surface toward the first curved surface.

20. The method of claim 19 further comprising passing collimated waves through the third curved surface.

21. The method of claim 19 further comprising selecting curvature of the first, second and third curved surfaces in relation to fixed curvature requirements of one of the surfaces for cooperating in reflecting and refracting waves for collimating waves.

22. An antenna apparatus, comprising:

(A) a generally biconvex refractive dielectric lens having first and second surfaces;

(B) a twist reflector mounted on the first surface;

(C) a subreflector mounted on a portion of the second surface, wherein said subreflector has a polarization grid;

(D) a feed point on the twist reflector opposite the subreflector, whereby radiation is reflected by the subreflector grid to impinge on the twist reflector where the radiation is orthogonally rotated to be collimated in a wave front passing through the subreflector grid and refracted by the second dielectric surface.

23. The apparatus of claim 22 wherein said portion of the second surface is a central portion, and wherein said subreflector has a surface which extends between said first and surfaces.

24. The apparatus of claim 23 wherein said subreflector surface is curved opposite of the second surface.

25. An antenna apparatus comprising:

(a) a one-piece, two-sided dielectric lens having a first curved reflective surface and an oppositely curved refractive surface, wherein said refractive surface has a mid-portion, being a second curved reflective surface, and having the same curvature as the first reflective surface;

(b) a feed point positioned on the lens opposite one reflective surface.

26. The apparatus of claim 25 wherein said first surface is convex.

27. The device of claim 26 wherein said refractive surface is convex, and wherein said midportion is concave.

28. The device of claim 27 wherein said feed point is located between the two reflective surfaces, embedded in the dielectric.

* * * * *